United States Patent [19]

Ray

[11] Patent Number: 4,600,084

[45] Date of Patent: Jul. 15, 1986

[54] HYDRAULIC MANIFOLD FOR TWO AND THREE STAGE MASTS

[75] Inventor: William C. Ray, Cedar Lake, Ind.

[73] Assignee: Allis-Chalmers Corporation, Milwaukee, Wis.

[21] Appl. No.: 669,360

[22] Filed: Nov. 8, 1984

[51] Int. Cl.[4] ..... B66B 9/20; E03B 0/00; F01B 29/04; F01B 1/02

[52] U.S. Cl. ..... 187/9 E; 137/561 A; 92/59; 92/61

[58] Field of Search ..... 187/9 E, 9 R; 137/561 A; 92/61, 59; 285/12, 150, 132

[56] References Cited

U.S. PATENT DOCUMENTS 3,485,323 12/1969 Ulinski ..... 92/61 X 4,018,307 4/1977 Ehrhardt et al. ..... 187/9 E 4,395,189 7/1983 Munten ..... 187/9 E X 4,494,568 1/1985 Young ..... 137/561 A

*Primary Examiner*—Joseph J. Rolla

*Assistant Examiner*—Gregory L. Huson

*Attorney, Agent, or Firm*—Charles L. Schwab; Arthur M. Streich

[57] ABSTRACT

A hydraulic manifold is provided on a primary mast section which maximizes the commonalty of hydraulic components used in the hydraulic lift control systems of two and three stage mast assemblies used in lift trucks. Two and three stage mast assemblies are illustrated using primary mast sections which are identical and using secondary mast sections which are nearly the same.

5 Claims, 8 Drawing Figures

HYDRAULIC MANIFOLD FOR TWO AND THREE STAGE MASTS

TECHNICAL FIELD

This invention relates to a hydraulic control system for a lift truck and more particularly to a hydraulic control system using a manifold adapted for use in both two and three stage masts.

BACKGROUND OF THE INVENTION

It has been a common practice in the lift truck industry to provide a hydraulic control system uniquely tailored to the particular mast provided on the lift truck. Thus, the hydraulic control system for a two stage mast characteristically will be different than the hydraulic control system for a three stage mast.

It is an object of the present invention to provide a hydraulic control system for the lift cylinders on the mast which can be adapted for use in both two and three stage masts.

More specifically, it is an object of this invention to provide a hydraulic manifold which mounts on the rear of the primary mast section for distributing pressure fluid to a pair of lift cylinders supported on the rear of the uprights of the primary mast section and wherein the manifold need not be repositioned on the primary mast section to accommodate the latter's use in either a two stage mast or a three stage mast.

It is a further object of the present invention to provide a manifold of the type hereinbefore described wherein plugged openings are available for supply of fluid to a carriage lift cylinder when the primary mast section is used in a three stage mast.

BRIEF SUMMARY OF THE INVENTION

The present invention is advantageously used in a lift truck which has a mast assembly including a primary mast section pivotally mounted on the front of a lift truck, a secondary mast section mounted on the primary mast section for vertical reciprocation relative thereto and a pair of lift jacks having cylinders mounted on the bottom of the primary mast section. In this type mast, the rods of the lift jacks are connected to the top of the secondary mast section whereby expansion of the lift jacks causes the secondary mast to vertically reciprocate relative to the primary mast section. The primary and secondary mast sections may be used in a three stage mast assembly having a tertiary mast section which carries a carriage lift jack. A novel hydraulic manifold is provided for the lift truck which includes a manifold block secured to the rear of the primary mast section. The block includes a first bore defining a first vertical passage terminating at its bottom in a supply port adapted for connection to a source of pressure fluid, second and third bores define a pair of laterally spaced delivery passages each extending between top and bottom ports at the top and bottom of the housing. The top ports of the delivery passages are adapted to receive plugs when the primary mast is used in a two stage mast assembly and are adapted to receive connectors for conduits connected to the carriage lift jack when the primary mast section is used in a three stage mast assembly. The manifold block also includes a fourth bore defining a transverse passage interconnecting the supply passage with the delivery passages and conduits connecting the bottom ports of the delivery passages in fluid communication with the lift jacks mounted on the primary mast section.

BRIEF DESCRIPTION OF THE DRAWINGS

The present invention is illustrated in the drawings in which.

DETAILED DESCRIPTION OF THE DRAWINGS

Figure 1:
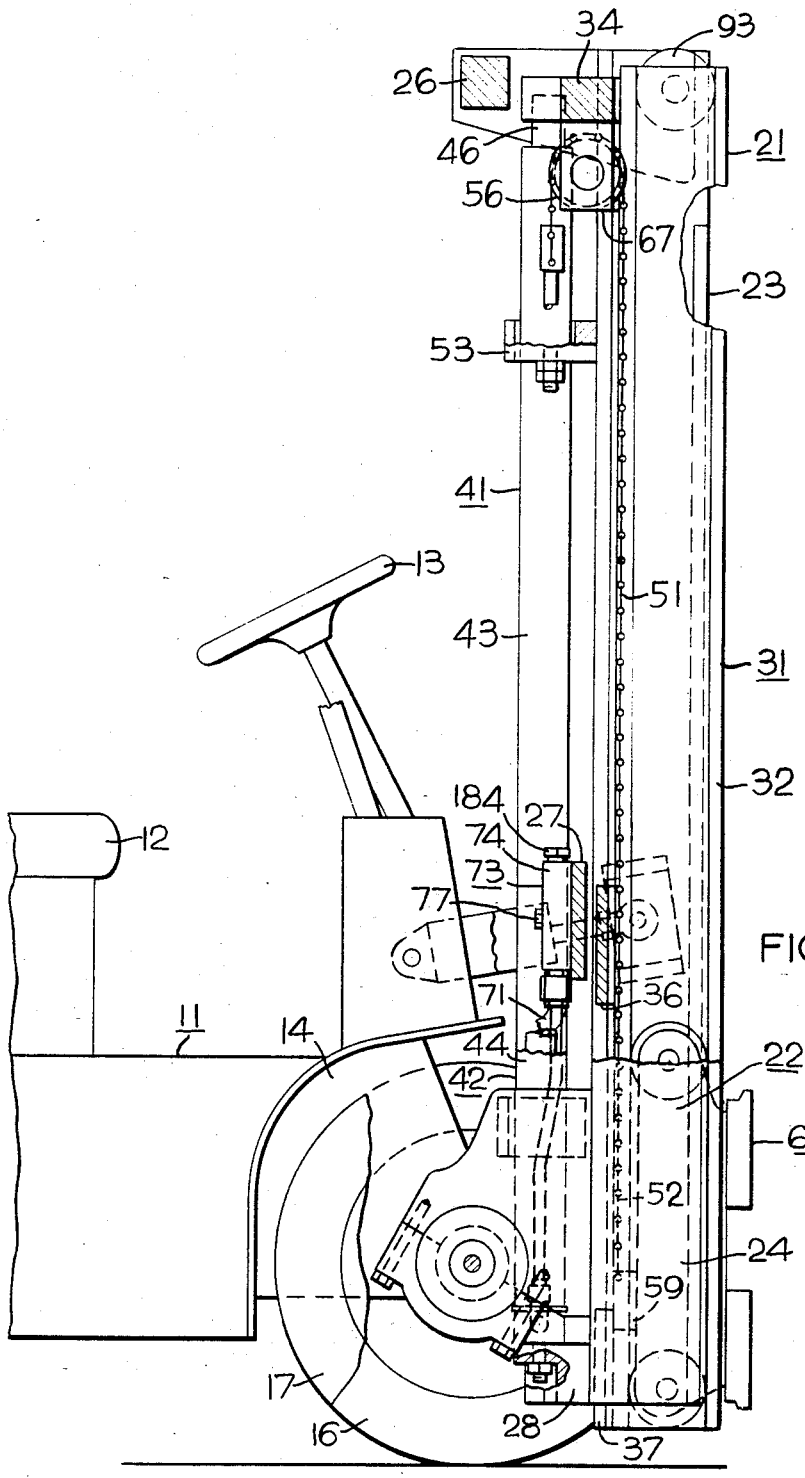
FIG. 1 is a partial side view of a lift truck with parts broken away for illustration purposes.
Figure 2:
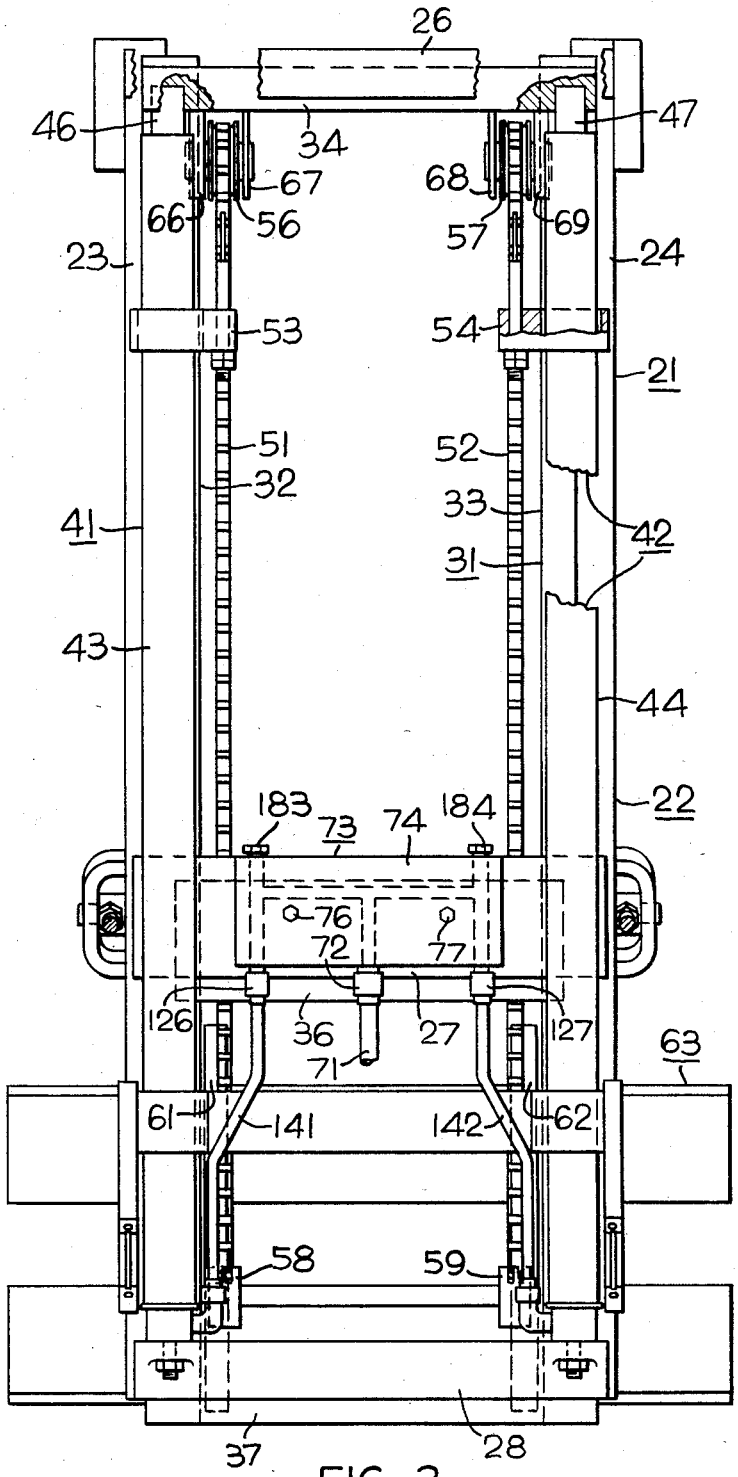
FIG. 2 is a rear view of the mast illustrated in FIG. 1 removed from the lift truck.

Referring to FIGS. 1 and 2, the lift truck 11 includes an operator's station or seat 12, steering means including a steering wheel 13, a frame 14 and a pair of non-steerable drive wheels 16, 17 which are driven by an engine, not shown, mounted on the rear of the lift truck frame 14. The lift truck 11 also includes steerable rear wheels, not shown, supporting the rear of the frame 14. A two stage mast assembly 21 is supported on the front of the lift truck 11 and includes a primary mast section 22 having a pair of channel section uprights 23, 24 which are rigidly interconnected by an upper brace 26, an intermediate brace 27 and a bottom brace 28. A secondary mast section 31 is mounted for vertical reciprocation on the primary mast section 21 and includes a pair of uprights 32, 33 which are rigidly interconnected by a top brace 34, an intermediate brace 36 and a bottom brace 37. A pair of lift jacks 41, 42 are disposed at the rear of the primary mast uprights 23, 24 with cylinders 43, 44 supported at their bottom ends on the primary mast transverse brace 28. The rods 46, 47 of the lift jacks 41, 42 have their upper ends positioned in sockets in the transverse brace 34 of the secondary mast section and upon expansion of the lift jacks 41, 42, the rods 46, 47 are extended upwardly to extend the secondary mast section upwardly relative to the primary mast section 21. A pair of lift chains 51, 52 have corresponding ends connected to brackets 53, 54 secured as by welding to the rear of the primary mast uprights 23, 24. The chains 51, 52 are reeved over idlers 56, 57 and extend downwardly therefrom to connector blocks 58, 59 on the rear of roller support brackets 61, 62 of the lift carriage 63. The idlers 56, 57 are supported on brackets 66, 67, 68, 69, which brackets are welded at their upper ends to the transverse brace 34 of the secondary mast section 31. Thus, upon expansion of the lift jacks 41, 42, the chains 51, 52 will cause the carriage 63 to be raised on the secondary mast uprights 32, 33.

Figure 5:
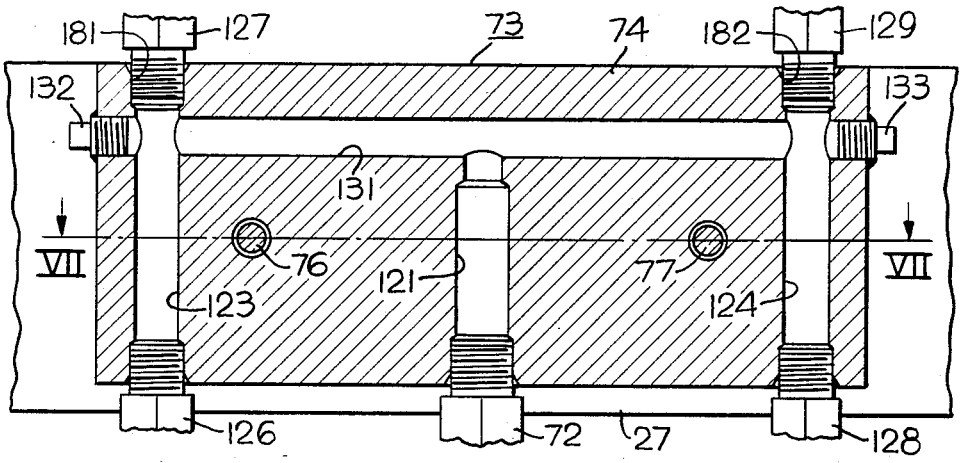
FIG. 5 is a view taken along the line V—V in FIG. 3.
Figure 7:
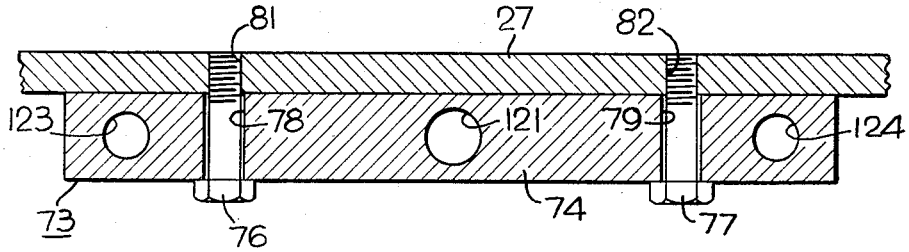
FIG. 7 is a view taken along the line VII—VII in FIG. 5.

A hydraulic control system is provided on the lift truck for supplying and controlling fluid to the lift jacks 41, 42 which includes a source of pressure fluid, not shown, which delivers pressure fluid by way of a control valve, not shown, to a supply conduit 71. The supply conduit 71 is connected by a connector 72 to a hydraulic manifold 73 which includes a manifold block 74 secured to the transverse brace 27 by a pair of cap screws 76, 77. As shown in FIGS. 5 and 7, the cap screws extend through openings or bores 78, 79 in the manifold block 74 and threadedly engage threaded openings 81, 82 in the transverse brace 27.

Figure 3:
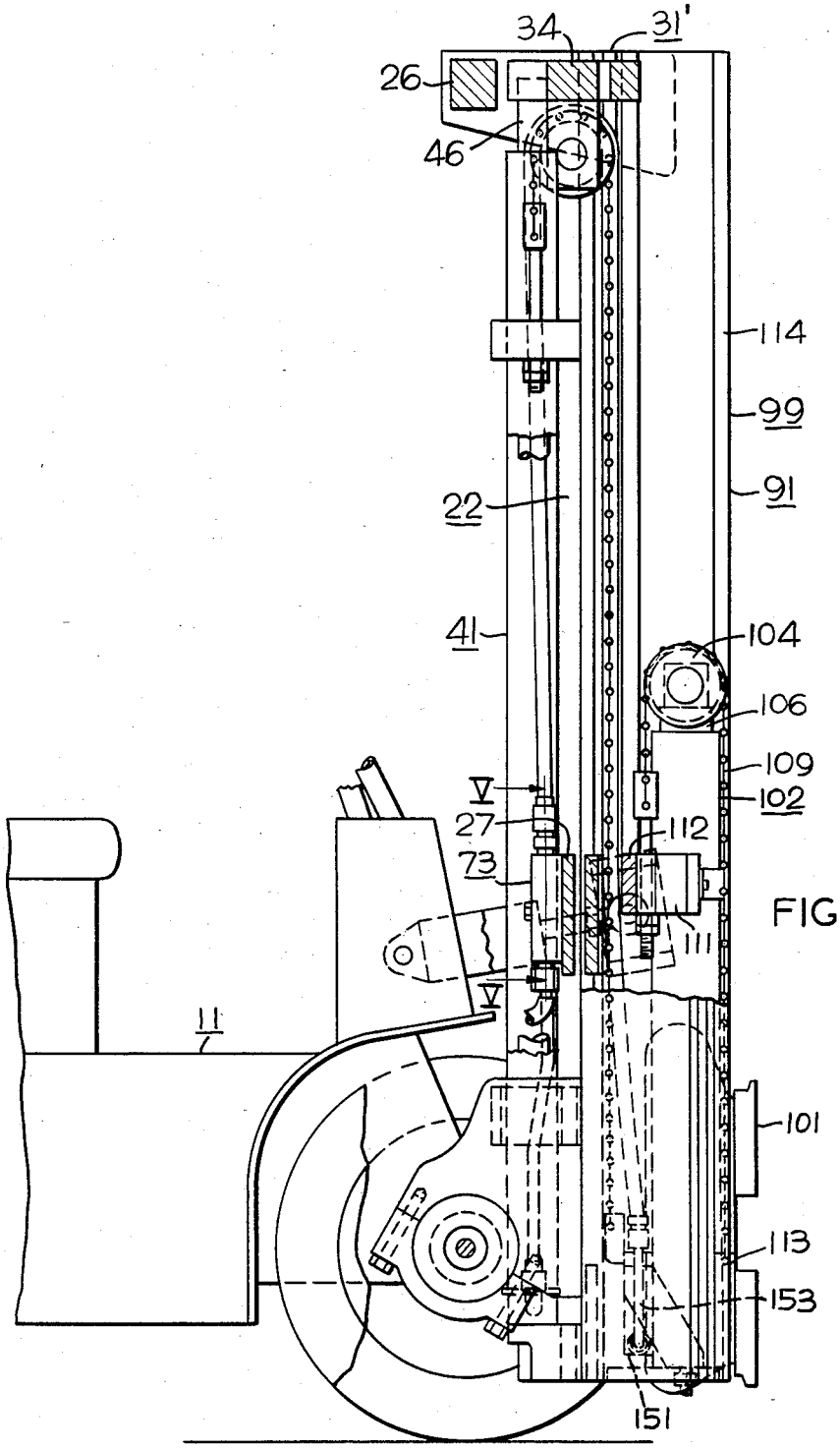
FIG. 3 is a partial side view of a lift truck mounting a three stage mast with parts broken away for illustration purposes.
Figure 4:
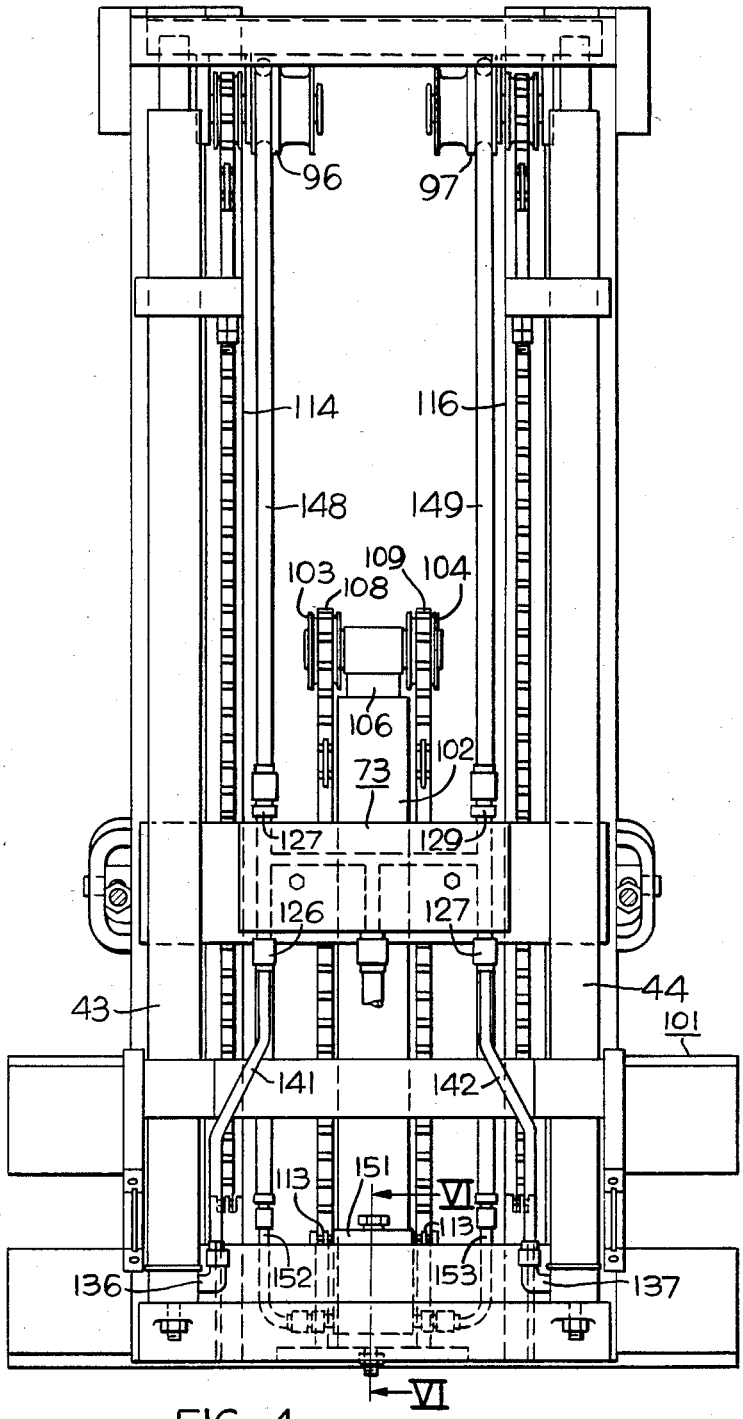
FIG. 4 is a rear view of the mast shown in FIG. 3 removed from the lift truck.

Referring to FIGS. 3 and 4, a three stage mast assembly 91 is shown mounted on the lift truck 11. The primary mast section 22 is identical in both the two stage mast assembly and the three stage mast assembly. The secondary mast section 31' of the three stage mast assembly 91 is section 31 of the two stage mast assembly 21 modified by the addition of upper rollers 93 and cutting out an upper portion of each of the front inner flanges of the secondary mast uprights 32, 33 to provide a space for the upper rollers 93. The three stage mast assembly 91 also includes a tertiary mast section 99 on which a lift truck carriage 101 is reciprocatively mounted. The tertiary mast section 99 also carries a carriage lift jack 102 having pulleys or idlers 103, 104 at the upper end of its rod 106. The idlers 103, 104 carry a pair of carriage lift chains 108, 109 having rear corresponding ends secured to a pair of brackets 111, only one of which is shown. The brackets 111 in turn are secured to a transverse brace 112 between the laterally spaced uprights 114, 116 of the tertiary mast section 99. The front corresponding ends of the lift chains 108, 109 are secured to brackets 113 on the lift carriage 101.

Figure 6:
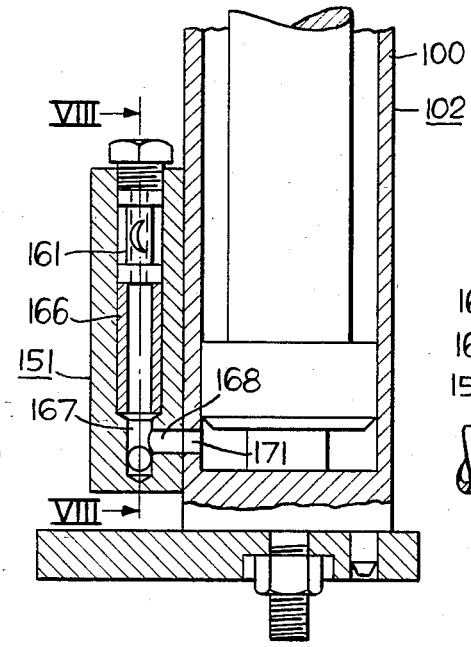
FIG. 6 is a view taken along the line VI—VI in FIG. 4.
Figure 8:
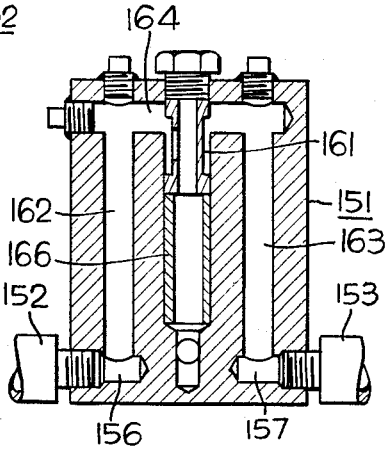
FIG. 8 is a view taken along the line VIII—VIII in FIG. 6.

Referring also to FIGS. 5 through 8, the hydraulic manifold 73 secured by cap screws 76, 77 to the transverse brace 27 can be fabricated as a separate item by drilling appropriate passages in the manifold block 74 and then tapping the openings. More specifically, a first bore in block 74 defines a vertical supply passage 121 having one end terminating within the block 74 and a second end terminating at a supply port in a bottom surface of block 74, with the supply port tapped to provide internal threads to receive the threaded connector 72. A second and third bore in block 74 define a pair of vertically extending delivery passages 123, 124 extend vertically through laterally opposite top and bottom surfaces of the block 74 and the opposite ends thereof are threaded to provide delivery ports which receive threaded connectors 126, 127, 128, 129. A fourth bore in block 74 defines a transverse passage 131 within block 74 and transverse passage 131 intersects delivery passages 123, 124 and the upper end of supply passage 121 thereby placing the delivery passages 123, 124 in fluid communication with the supply passage 121 and with the supply hose or conduit 71. The opposite ends of the transverse connector passage 131 are plugged by threaded plugs 132, 133, which are welded to the housing 74 to positively prevent leakage of fluid. As shown in FIGS. 3 and 4, the connectors 126, 127 connect conduits 141, 142 to the manifold 73. The conduits 141, 142 are lift jack delivery conduits and have their lower ends connected to the bottom of the lift cylinders 43, 44 by L-shaped connectors 136, 137. The connectors 127, 129 connect a pair of flexible hoses 148, 149 to the upper end of the delivery passages 123, 124 and the opposite corresponding ends of the hoses 148, 149 are connected as shown in FIGS. 4 and 8 to a hydraulic junction block 151 by a pair of rigid hydraulic conduits 152, 153. As shown in FIGS. 6 and 8, the rigid conduits 152, 153 deliver hydraulic fluid to hydraulic junction block 151 by way of ports 156, 157 which are connected to a flow regulating device 161 by vertical passages 162, 163 and a transverse passage 164. Fluid passes through the flow regulating device 161 to the lower end of the carriage lift cylinder 100 by way of a cylindrical or tubular spacer 166, passages 167, 168 in the hydraulic junction block 151 and a fluid delivery port 171 in the lift cylinder 100.

When the hydraulic manifold 73 is used in the two stage mast assembly, as shown in FIGS. 1 and 2, the ports or threaded openings 181, 182 at the upper ends of the delivery passages 123, 124, illustrated in FIG. 5, are plugged by threaded plugs 183, 184 screwed thereinto. Thus, the hydraulic manifold 73 is used n both the two stage mast 21 and the three stage mast 91 thereby reducing the number of parts that need be carried in inventory for manufacturing and servicing purposes. Also, the manifold facilitates producing a primary mast section 22 which can be used interchangeably in two and three stage mast assemblies.

The embodiments of the invention in which an exclusive property or privilege is claimed are defined as follows:

1. In a lift truck having a mast assembly including a primary mast section mounted on the front of the lift truck, a secondary mast section mounted on the primary mast section for vertical reciprocation relative thereto and a pair of lift jacks having cylinders mounted on the bottom of the primary mast section and rods connected to the top of the secondary mast section and wherein the primary and secondary mast section may be used in a three stage mast assembly having a tertiary mast section with a carriage lift jack, a hydraulic manifold comprising:

a manifold block secured to the rear of said primary mast section including a first bore in said block defining a vertical supply passage having one end terminating within said block and a second end terminating at a supply port in the bottom surface of said block and adapted for connection to a source of pressure fluid, a second and third bore in said block defining a pair of laterally spaced delivery passages each extending upwardly predetermined distances from ports in said bottom surface, one of said delivery passages terminating at the top of said block at a top port adapted to receive a plug when said primary mast is used in a two stage mast assembly and to receive a connector for a conduit connected to said carriage lift jack when said primary mast section is used in a three stage mast assembly, a fourth bore in said block defining a transverse passage interconnecting said supply passage with said delivery passages, and conduits connecting said bottom ports in fluid communication with said lift jacks, respectively.

2. The combination of claim 1 wherein said primary mast section includes a pair of uprights which are rigidly interconnected by a plurality of transverse braces and wherein said manifold block constitutes a part of one of said braces.

3. The combination of claim 2 wherein said manifold block is releasably secured to the rear of said one brace.

4. The combination of claim 3 wherein said brace is disposed at a vertically intermediate position on said uprights.

5. In a lift truck having a mast assembly including a primary mast section mounted on the front of the lift truck, a secondary mast section mounted on the primary mast section for vertical reciprocation relative thereto and a pair of lift jacks having cylinders mounted on the bottom of the primary mast section and rods connected to the top of the secondary mast section and wherein the primary and secondary mast sections may be used in a three stage mast assembly having a tertiary mast section with a carriage lift jack, a hydraulic manifold comprising:

a manifold block secured to the rear of said primary mast section including a first bore in said block defining a vertical supply passage having one end terminating within said block and a second end terminating at a supply port in the bottom surface of said block and adapted for connection to a source of pressure fluid, a second and third bore in said block defining a pair of laterally spaced and vertically extending delivery passages each extending between top and bottom ports at the top and bottom surfaces of said block, said top ports being adapted to receive plugs when said primary mast section is used in a two stage mast assembly and to receive connectors for conduits connected to a carriage lift jack when said primary mast section is used in a three stage mast assembly, a fourth bore, in said block defining a transverse passage interconnecting said supply passage with said delivery passages, and conduits connecting said bottom ports in fluid communication with said lift jacks, respectively.

* * * * *